US010790074B1

(12) United States Patent
Chen et al.

(10) Patent No.: US 10,790,074 B1
(45) Date of Patent: Sep. 29, 2020

(54) PTC CIRCUIT PROTECTION DEVICE

(71) Applicant: FUZETEC TECHNOLOGY CO., LTD., New Taipei (TW)

(72) Inventors: Jack Jih-Sang Chen, New Taipei (TW); Chang-Hung Jiang, New Taipei (TW)

(73) Assignee: FUZETEC TECHNOLOGY CO., LTD., New Taipei (TW)

( * ) Notice: Subject to any disclaimer, the term of this patent is extended or adjusted under 35 U.S.C. 154(b) by 0 days.

(21) Appl. No.: 16/355,883

(22) Filed: Mar. 18, 2019

(51) Int. Cl.
*H01C 7/02* (2006.01)
*H01C 1/14* (2006.01)
*H01C 7/00* (2006.01)

(52) U.S. Cl.
CPC ..... *H01C 7/028* (2013.01); *H01C 1/1406* (2013.01); *H01C 7/008* (2013.01); *H01C 7/027* (2013.01)

(58) Field of Classification Search
CPC ..... H01C 7/028; H01C 1/1406; H01C 7/008; H01C 7/027
USPC ..... 338/22 R
See application file for complete search history.

(56) References Cited

U.S. PATENT DOCUMENTS 8,558,655 B1 * 10/2013 Chen ..... H01C 7/027 338/13
2007/0024413 A1 * 2/2007 Namba ..... H01C 7/027 338/22 R

* cited by examiner

*Primary Examiner* — Nguyen Tran
*Assistant Examiner* — Iman Malakooti
(74) *Attorney, Agent, or Firm* — Reches Patent

(57) ABSTRACT

A PTC circuit protection device includes a PTC polymer material and two electrodes attached to the PTC polymer material. The PTC polymer material includes a polymer matrix and a particulate conductive filler dispersed in the polymer matrix. The polymer matrix is made from a polymer composition that contains a non-grafted polyolefin. The conductive filler includes first tungsten carbide particles having a first average Fisher sub-sieve particle size of less than 2.5 μm and a first particle size distribution with a particle size D10 being less than 2.0 μm and a particle size D100 being less than 10.0 μm.

20 Claims, 1 Drawing Sheet

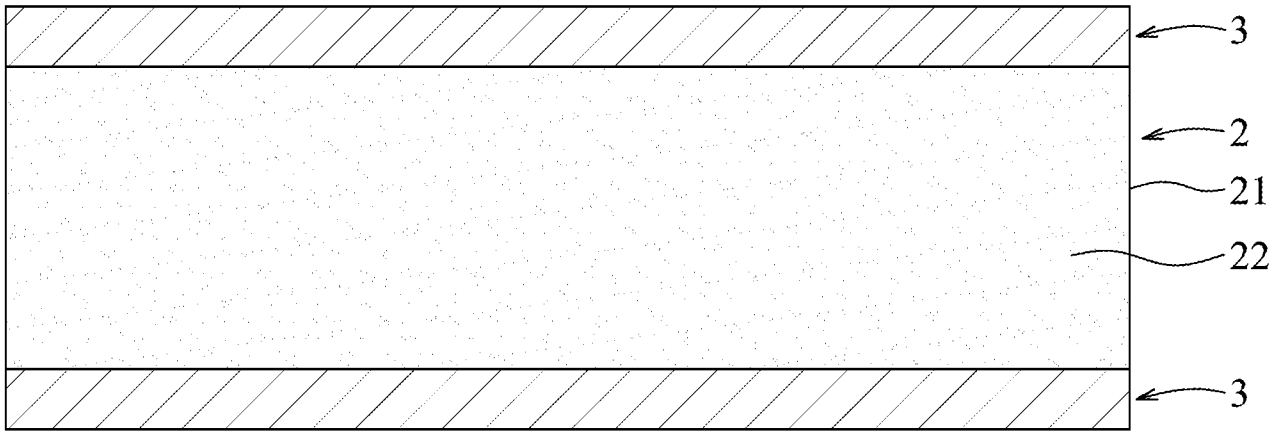
3
2
21
22
3

PTC CIRCUIT PROTECTION DEVICE

FIELD

This disclosure relates to a positive temperature coefficient (PTC) circuit protection device, more particularly to a PTC circuit protection device having excellent electrical stability under high voltage.

BACKGROUND

A PTC element exhibits a PTC effect that renders the same to be useful as a circuit protection device, such as a resettable fuse. The PTC element includes a PTC polymer material, and first and second electrodes attached to two opposite surfaces of the PTC polymer material.

The PTC polymer material includes a polymer matrix that contains a crystalline region and a non-crystalline region, and a particulate conductive filler dispersed in the non-crystalline region of the polymer matrix and formed into a continuous conductive path for electrical conduction between the first and second electrodes. The PTC effect is referred to as a phenomenon that when the temperature of the polymer matrix is raised to its melting point, crystals in the crystalline region start to melt, which results in generation of a new non-crystalline region. As the new non-crystalline region is increased to an extent to merge into the original non-crystalline region, the conductive path of the particulate conductive filler will become discontinuous and the resistance of the PTC polymer material will sharply increase, thereby resulting in electrical disconnection between the first and second electrodes.

Although the conductivity of the PTC polymer material can be considerably increased by using the particulate non-carbonaceous particles, such as metal powders, such conductive non-carbonaceous particles having high conductivity tend to result in the formation of undesired electric arc within the PTC polymer material during use.

The electric arc thus formed could deteriorate the molecular structure of the polymer matrix of the PTC polymer material, thereby causing unstable electrical property of the PTC element and reduction in service life of the PTC element.

U.S. Pat. No. 10,147,525B1 discloses a PTC polymer material. The PTC polymer material includes a polymer matrix and tungsten carbide particles dispersed in the polymer matrix. The tungsten carbide particles have a total carbon content ranging from 5.0 wt % to 6.0 wt % based on the total weight of the tungsten carbide particles, so that the PTC polymer material could be operated under 12 Vdc and electrical stability thereof may be improved. However, there is still a need to improve the electrical stability of the PTC polymer material under a relatively high voltage (such as 30 Vdc).

SUMMARY

Therefore, an object of the disclosure is to provide a PTC circuit protection device that can alleviate at least one of the drawbacks of the prior art.

The PTC circuit protection device includes a PTC polymer material and two electrodes attached to the PTC polymer material. The PTC polymer material includes a polymer matrix and a particulate conductive filler dispersed in the polymer matrix.

The polymer matrix is made from a polymer composition that contains a non-grafted polyolefin. The particulate conductive filler includes first tungsten carbide particles having a first average Fisher sub-sieve particle size (FSSS) of less than 2.5 μm and a first particle size distribution with a particle size D10 being less than 2.0 μm and a particle size D100 being less than 10.0 μm.

BRIEF DESCRIPTION OF THE DRAWING

Other features and advantages of the disclosure will become apparent in the following detailed description of the embodiment(s) with reference to the accompanying drawing, of which:

FIG. 1 is a schematic view of the embodiment of a PTC circuit protection device according to this disclosure.

DETAILED DESCRIPTION

FIG. 1 illustrates the embodiment of a PTC circuit protection device that includes a PTC polymer material 2 and two electrodes 3 respectively attached to two opposite surfaces of the PTC polymer material 2.

The PTC polymer material 2 includes a polymer matrix 21 and a particulate conductive filler 22 dispersed in the polymer matrix 21. The polymer matrix 21 is made from a polymer composition that contains a non-grafted polyolefin.

In certain embodiments, the non-grafted polyolefin is non-grafted polyethylene. In certain embodiments, the non-grafted polyolefin is high density polyethylene (HDPE).

In certain embodiments, the polymer matrix 21 further includes a grafted polyolefin. In certain embodiments, the grafted polyolefin is carboxylic acid anhydride-grafted polyethylene. The carboxylic acid anhydride-grafted polyethylene may be carboxylic acid anhydride-grafted high density polyethylene. In this embodiment, the carboxylic acid anhydride-grafted high density polyethylene is maleic anhydride-grafted high density polyethylene.

According to this disclosure, the particulate conductive filler 22 includes first tungsten carbide particles having a first average Fisher sub-sieve particle size of less than 2.5 μm, and a first particle size distribution with a particle size D10 being less than 2.0 μm and a particle size D100 being less than 10.0 μm.

In certain embodiments, the first average FSSS particle size of the first tungsten carbide particles is greater than 1.9 μm. In certain embodiments, the first average FSSS particle size of the first tungsten carbide particles is less than 2.0 μm.

In certain embodiments, the particle size D10 of the first tungsten carbide particles is greater than 0.9 μm. In certain embodiments, the particle size D10 of the first tungsten carbide particles is less than 1.0 μm.

In certain embodiments, the particle size D100 of the first tungsten carbide particles is greater than 7.0 μm. In certain embodiments, the particle size D100 of the first tungsten carbide particles is less than 8.0 μm.

The first tungsten carbide particles may have a total carbon content ranging from 5.0 wt % to 6.1 wt % based on the total weight of the first tungsten carbide particles. In certain embodiments, the first tungsten carbide particles have a total carbon content ranging from 5.6 wt % to 6.1 wt % based on the total weight of the first tungsten carbide particles. In other embodiments, the first tungsten carbide particles have a total carbon content ranging from 5.6 wt % to 5.9 wt % based on the total weight of the first tungsten carbide particles.

In certain embodiments, based on the total weight of the PTC polymer material 2, the polymer matrix 21 is present in an amount ranging from 4 wt % to 6 wt %, and the particulate conductive filler 22 is present in an amount ranging from 94 wt % to 96 wt %. In certain embodiments, the PTC polymer material 2 includes at least 48 wt % of the first tungsten carbide particles based on the total weight of the PTC polymer material 2.

In certain embodiments, the particulate conductive filler 22 further includes second tungsten carbide particles. The second tungsten carbide particles have a second average FSSS particle size greater than the first average FSSS particle size of the first tungsten carbide particles, and have a second particle size distribution that is greater than the first particle size distribution of the first tungsten carbide particles. That is, the particles size D10 and the particles size D100 of the second tungsten carbide particles are greater than those of the first tungsten carbide particles.

In certain embodiments, the first tungsten carbide particles are present in an amount higher than or equal to the amount of the second tungsten carbide particles. In certain embodiments, as mentioned above, the first tungsten carbide particles are present in an amount of at least 48 wt % based on the total weight of the PTC polymer material.

The disclosure will be further described by way of the following examples and comparative example. However, it should be understood that the following examples and comparative example are solely intended for the purpose of illustration and should not be construed as limiting the disclosure in practice.

EXAMPLES

Example 1 (E1)

9 grams of HDPE (purchased from Formosa Plastics Corp; catalog no.: HDPE9002) serving as the non-grafted polyolefin, 9 grams of maleic anhydride-grafted HDPE (purchased from Dupont, catalog no.: MB100D) serving as the grafted polyolefin, and 282 grams of a tungsten carbide particles (hereinafter referred to as WC-1 particles) serving as the first tungsten carbide particles were compounded in a Brabender mixer.

The WC-1 particles have an average Fisher sub-sieve particle size of 1.96 μm, a total carbon content of 5.6 wt % and a particle size distribution with a particle size D10 being 0.97 μm and a particle size D100 being 7.09 μm (as shown in Table 1). The WC-1 particles were made by subjecting tungsten metal and carbon particles to carbonization reaction in the presence of hydrogen at a temperature of around 1750° C., followed by crumbling the resultant product into particles using high compressed air. The compounding temperature was 200° C., the stirring rate was 50 rpm, the pressing weight was 5 kg, and the compounding time was 10 minutes.

The compounded mixture was hot pressed so as to form a thin sheet of the PTC polymer material having a thickness of 0.28 mm. The hot pressing temperature was 200° C., the hot pressing time was 4 minutes, and the hot pressing pressure was 80 kg/cm$^2$.

Two copper foil sheets (serving as the electrodes) were respectively attached to two opposite surfaces of the thin sheet and were hot pressed under 200° C. and 80 kg/cm$^2$ for 4 minutes to form a sandwiched structure of a PTC laminate having a thickness of 0.35 mm. The PTC laminate was cut into a plurality of test samples with a size of 4.5 mm×3.2 mm×0.35 mm, and each test sample was irradiated by a cobalt-60 source with a total radiation dose of 150 kGy.

Examples 2 and 3 (E2 and E3)

The procedures and conditions in preparing the test samples of E2 and E3 were similar to those of E1, except for the amounts of the first tungsten carbide particles, HDPE, and grafted-HDPE.

Examples 4 and 5 (E4 and E5)

The procedure and conditions in preparing the test samples of E4 and E5 were similar to those of E3. The difference resides in the type of the first tungsten carbide particles thus used, in which WC-2 particles were used in E4 and WC-3 particles were employed in E5.

The WC-2 particles have an average Fisher sub-sieve particle size of 2.45 μm, a total carbon content of 5.9 wt % and a particle size distribution with a particle size D10 being 1.90 μm and a particle size D100 being 9.86 μm (as shown in Table 1). The WC-3 particles have a Fisher sub-sieve particle size of 2.40 μm, a total carbon content of 6.1 wt % and a particle size distribution with a particle size D10 being 1.52 μm and a particle size D100 being 8.92 μm (as shown in Table 1).

Examples 6 and 7 (E6 and E7)

The procedures and conditions in preparing the test samples of E6 and E7 were similar to those of E3, except that the particulate conductive fillers of E6 and E7 further include second tungsten carbide particles (hereinafter referred to as WC-4 particles).

The WC-4 particles have an average Fisher sub-sieve particle size of 3.10 μm, a total carbon content of 5.6 wt % and a particle size distribution with a particle size D10 being 2.56 μm and a particle size D100 being 18.50 μm (as shown in Table 1). The WC-4 particles were made by subjecting tungsten metal and carbon particles to carbonization reaction in the presence of hydrogen at a temperature of around 1750° C. The amounts of HDPE, grafted-HDPE, the first tungsten carbide particles and the second tungsten carbide particles are shown in Table 1.

Comparative Examples 1 to 5 (CE1 to CE5)

The procedures and conditions in preparing the test samples of CE1 to CE5 were similar to those of E1 to E5, except that the WC-4 particles were employed in CE1 to CE3, and that WC-5 particles and WC-6 particles were respectively employed in CE4 and CE5. Specifically, the WC-5 particles have an average Fisher sub-sieve particle size of 2.93 μm, a total carbon content of 5.9 wt % and a particle size distribution with a particle size D10 being 2.45 μm and a particle size D100 being 16.21 μm (as shown in Table 1). The WC-6 particles have an average Fisher sub-sieve particle size of 2.91 μm, a total carbon content of 6.1 wt % and a particle size distribution with a particle size D10 being 2.08 μm and a particle size D100 of 15.34 μm (as shown in Table 1).

The electrical properties of the test samples of E1 to E7 and CE1 to CE5 were determined, and the results are shown in Table 2, in which $R_i$ represents initial resistance (ohm) before the performance tests were conducted, and V-R represents the volume resistivity (ohm-cm).

TABLE 1

| | Polymer matrix | | Particulate conductive filler | | | | | | | | | | | |
|---|---|---|---|---|---|---|---|---|---|---|---|---|---|---|
| | | Grafted- | First tungsten carbide (WC) particles | | | | | | Second tungsten carbide particles | | | | | |
| | HDPE (wt%) | HDPE (wt%) | Type | Wt % | FSSS (μm) | D10 (μm) | D100 (μm) | Total W/C(wt %) | Type | Wt % | FSSS (μm) | D10 (μm) | D100 (μm) | Total W/C(wt %) |
| E1 | 3.0 | 3.0 | WC-1 | 94.0 | 1.96 | 0.97 | 7.09 | 94.4/5.6 | | | | | | |
| E2 | 2.5 | 2.5 | WC-1 | 95.0 | 1.96 | 0.97 | 7.09 | 94.4/5.6 | | | | | | |
| E3 | 2.0 | 2.0 | WC-1 | 96.0 | 1.96 | 0.97 | 7.09 | 94.4/5.6 | | | | | | |
| E4 | 2.0 | 2.0 | WC-2 | 96.0 | 2.45 | 1.90 | 9.86 | 94.1/5.9 | | | | | | |
| E5 | 2.0 | 2.0 | WC-3 | 96.0 | 2.40 | 1.52 | 8.92 | 93.9/6.1 | | | | | | |
| E6 | 2.0 | 2.0 | WC-1 | 72.0 | 1.96 | 0.97 | 7.09 | 94.4/5.6 | WC-4 | 24.0 | 3.10 | 2.56 | 18.50 | 94.4/5.6 |
| E7 | 2.0 | 2.0 | WC-1 | 48.0 | 1.96 | 0.97 | 7.09 | 94.4/5.6 | WC-4 | 48.0 | 3.10 | 2.56 | 18.50 | 94.4/5.6 |
| CE1 | 3.0 | 3.0 | WC-4 | 94.0 | 3.10 | 2.56 | 18.50 | 94.4/5.6 | | | | | | |
| CE2 | 2.5 | 2.5 | WC-4 | 95.0 | 3.10 | 2.56 | 18.50 | 94.4/5.6 | | | | | | |
| CE3 | 2.0 | 2.0 | WC-4 | 96.0 | 3.10 | 2.56 | 18.50 | 94.4/5.6 | | | | | | |
| CE4 | 2.0 | 2.0 | WC-5 | 96.0 | 2.93 | 2.45 | 16.21 | 94.1/5.9 | | | | | | |
| CE5 | 2.0 | 2.0 | WC-6 | 96.0 | 2.91 | 2.08 | 15.34 | 93.9/6.1 | | | | | | |

Performance Tests

Two nickel foil sheets were respectively attached to two copper foil sheets of each test samples, so as to form test devices of each of E1 to E7 and CE1 to CE5 for the following tests.

<Breakdown Test>

Ten test devices of each of E1 to E7 and CE1 to CE5 were subjected to a breakdown test, which was first conducted under an initial voltage of 8 Vdc and a fixed current of 10 A by switching each test device on for 60 seconds and then off for 60 seconds per cycle for 10 cycles. If all of the ten test devices were not burnt out (i.e., a passing ratio of 100%), another ten test devices were then subjected to a new round of the breakdown test, in which the applied voltage was increased to 12 Vdc (i.e., with an increment of 4 Vdc per round). The maximum endurable voltage (i.e., the breakdown voltage) of each of the test devices of E1 to E7 and CE1 to CE5, at which all of the ten test devices were not burnt out (i.e., a passing ratio of 100%) was recorded. The results are shown in Table 2.

It can be seen from Table 2 that, the breakdown voltages of E1 to E5 (40 to 48 Vdc) are much higher than those of CE1 to CE5 (8 to 12 Vdc). The result indicates that the PTC device containing the conductive tungsten carbide particles having a relatively small particle size and particle size distribution (e.g., those with the average Fisher sub-sieve particle size of less than about 2.5 μm, and the first particle size distribution with D10 being less than 2.0 μm and D100 being less than 10.0 μm) can effectively withstand breakdown under a relatively higher voltage.

Moreover, as compared with CE3, the test devices of E6 and E7, which further include WC-1 particles having a relatively small particle size (particularly in an amount not lower than the amount of the WC-4 particles having a relatively high particle size), exhibit relatively high breakdown voltage.

Therefore, the applicant infers that the conductive tungsten carbide particles having a relatively small particle size may have less contact with each other (i.e., being prone to separation) under high voltage and high current, and the undesired electric arc and flashover can thus be avoided, thereby preventing the damage or burning down of the PTC devices.

<Switching Cycle Test>

Ten test devices of each of E1 to E7 and CE1 to CE5 were subjected to a switching cycle test. The switching cycle test was conducted under a voltage of 30 Vdc and a current of 10 A by switching each test device on for 60 seconds and then off for 60 seconds per cycle for 7200 cycles. The resistances of each test device before ($R_i$) and after ($R_f$) the 7200 cycles were measured. A percentage of variation of the resistances ($R_f/R_i \times 100\%$) of the test devices of each of E1 to E7 and CE1 to CE5 was determined. A pass ratio is calculated based on the formula: n/10×100%, in which n represents the number of the test devices passing the cycle endurance test without being burnt. The results of the cycle endurance test are shown in Table 2.

Table 2 shows that the test devices of each of E1 to E7 have a passing ratio of 100% during the cycle endurance test, while the test devices of each of CE1 to CE5 have a pass ratio of not higher than 20%. Besides, the resistance variance among the test devices of E1 to E7 is much lower than that among CE1 to CE5.

<Aging Test>

Ten test devices of each of E1 to E7 and CE1 to CE5 were subjected to an aging test. The aging test was conducted by applying a voltage of 30 Vdc and a current of 10 A to each test sample for 1000 hours. The resistances of each test device before ($R_i$) and after ($R_f$) the 1000 hours were measured. A percentage of variation ($R_f/R_i \times 100\%$) of the resistances of the test devices of each of E1 to E7 and CE1 to CE5 was determined. A pass ratio is calculated based on the formula: n/10×100%, in which n represents the number of the test devices passing the aging test without being burnt. The results of the aging test are shown in Table 2.

Table 2 shows that the test devices of each of E1 to E7 have a passing ratio of 100% in the aging test, while the test devices of each of CE1 to CE5 have a pass ratio not higher than 20%. Besides, the resistance variance ($R_f/R_i$) among the test devices of E1 to E7 is much lower than that among CE1 to CE5.

TABLE 2

| | Test sample | | Break-down | Cycle endurance test (30Vdc/10A, 7200 cycles) | | Aging test (30 Vdc/10 A, 1000 hours) | |
|---|---|---|---|---|---|---|---|
| | Ri (ohm) | V-R (cm * ohm) | test Vdc | $R_f/R_1 \times 100\%$ | Pass ratio | $R_f/R_1 \times 100\%$ | Pass ratio |
| E1 | 0.00452 | 0.01860 | 48 | 2777% | 100% | 1232% | 100% |
| E2 | 0.00403 | 0.01658 | 48 | 2674% | 100% | 1259% | 100% |

TABLE 2-continued

| | Test sample | | Break-down | Cycle endurance test (30Vdc/10A, 7200 cycles) | | Aging test (30 Vdc/10 A, 1000 hours) | |
|---|---|---|---|---|---|---|---|
| | Ri (ohm) | V-R (cm * ohm) | test Vdc | $R_f/R_1$ × 100% | Pass ratio | $R_f/R_1$ × 100% | Pass ratio |
| E3 | 0.00361 | 0.01485 | 48 | 2886% | 100% | 1198% | 100% |
| E4 | 0.00385 | 0.01584 | 40 | 2751% | 100% | 1365% | 100% |
| E5 | 0.00407 | 0.01675 | 40 | 3702% | 100% | 2012% | 100% |
| E6 | 0.00396 | 0.01629 | 36 | 5730% | 100% | 2861% | 100% |
| E7 | 0.00426 | 0.01753 | 32 | 6969% | 100% | 3769% | 100% |
| CE1 | 0.00524 | 0.02156 | 12 | 12029% | 20% | 8057% | 10% |
| CE2 | 0.00448 | 0.01843 | 12 | 12533% | 20% | 8869% | 20% |
| CE3 | 0.00405 | 0.01666 | 12 | 13265% | 10% | 9124% | 20% |
| CE4 | 0.00423 | 0.01740 | 12 | 14572% | 10% | 12328% | 10% |
| CE5 | 0.00511 | 0.02102 | 8 | NA | 0% | NA | 0% |

"NA" means not available.

In conclusion, with the inclusion of small tungsten carbide particles (i.e., those having the average Fisher sub-sieve particle size of less than 2.5 μm, and the particle size distribution with D10 being less than 2.0 μm and D100 being less than 10.0 μm), the PTC circuit protection device of the present disclosure can be operated under a relatively high voltage (i.e., higher than 30 Vdc) and still exhibits good electrical stability.

In the description above, for the purposes of explanation, numerous specific details have been set forth in order to provide a thorough understanding of the embodiment(s). It will be apparent, however, to one skilled in the art, that one or more other embodiments may be practiced without some of these specific details. It should also be appreciated that reference throughout this specification to "one embodiment," "an embodiment," an embodiment with an indication of an ordinal number and so forth means that a particular feature, structure, or characteristic may be included in the practice of the disclosure. It should be further appreciated that in the description, various features are sometimes grouped together in a single embodiment, figure, or description thereof for the purpose of streamlining the disclosure and aiding in the understanding of various inventive aspects, and that one or more features or specific details from one embodiment may be practiced together with one or more features or specific details from another embodiment, where appropriate, in the practice of the disclosure.

While the disclosure has been described in connection with what is (are) considered the exemplary embodiment(s), it is understood that this disclosure is not limited to the disclosed embodiment(s) but is intended to cover various arrangements included within the spirit and scope of the broadest interpretation so as to encompass all such modifications and equivalent arrangements.

We claim:

1. A PTC circuit protection device comprising:

a PTC polymer material that includes a polymer matrix and a particulate conductive filler dispersed in said polymer matrix; and two electrodes attached to said PTC polymer material;

wherein said polymer matrix is made from a polymer composition that contains a non-grafted polyolefin; and wherein said conductive filler includes first tungsten carbide particles having a first average Fisher sub-sieve particle size of less than 2.5 μm and a first particle size distribution with a particle size D10 being less than 2.0 μm and a particle size D100 being less than 10.0 μm, and second tungsten carbide particles having a second average FSSS particle size greater than said first average FSSS particle size of said tungsten carbide particles, and having a second particle size distribution greater than said first particle size distribution.

2. The PTC circuit protection device as claimed in claim 1, wherein said first average Fisher sub-sieve particle size of said first tungsten carbide particles is greater than 1.9 μm.

3. The PTC circuit protection device as claimed in claim 1, wherein said first average Fisher sub-sieve particle size of said first tungsten carbide particles is less than 2.0 μm.

4. The PTC circuit protection device as claimed in claim 1, wherein said particle size D10 of said first tungsten carbide particles is greater than 0.9 μm.

5. The PTC circuit protection device as claimed in claim 1, wherein said particle size D10 of said first tungsten carbide particles is less than 1.0 μm.

6. The PTC circuit protection device as claimed in claim 1, wherein said particle size D100 of said first tungsten carbide particles is greater than 7.0 μm.

7. The PTC circuit protection device as claimed in claim 1, wherein said particle size D100 of said first tungsten carbide particles is less than 8.0 μm.

8. The PTC circuit protection device as claimed in claim wherein said first tungsten carbide particles are present in an amount higher than or equal to the amount of said second tungsten carbide particles.

9. The PTC circuit protection device as claimed in claim 8, wherein said first tungsten carbide particles are present in an amount of at least 48 wt % based on the total weight of said PTC polymer material.

10. The PTC circuit protection device as claimed in claim 1, wherein said polymer matrix is present in an amount ranging from 4 to 6 wt % and said conductive filler is present in an amount ranging from 94 to 96 wt % based on the total weight of said PTC polymer material.

11. The PTC circuit protection device as claimed in claim 1, wherein said non-grafted polyolefin is high density polyethylene.

12. The PTC circuit protection device as claimed in claim 1, wherein said polymer composition further includes a grafted polyolefin.

13. The PTC circuit protection device as claimed in claim 12, wherein said grafted polyolefin is carboxylic acid anhydride-grafted high density polyethylene.

14. The PTC circuit protection device as claimed in claim 1, wherein said first tungsten carbide particles have a total carbon content ranging from 5.0 wt % to 6.1 wt % based on the total weight of said first tungsten carbide particles.

15. The PTC circuit protection device as claimed in claim 1, wherein said first tungsten carbide particles have a total carbon content ranging from 5.6 wt % to 5.9 wt % based on the total weight of said first tungsten carbide particles.

16. A PTC circuit protection device comprising:

a PTC polymer material that includes a polymer matrix and a particulate conductive filler dispersed in said polymer matrix; and two electrodes attached to said PTC polymer material;

wherein said polymer matrix is made from a polymer composition that contains a non-grafted polyolefin;

wherein said conductive filler includes first tungsten carbide particles having a first average Fisher sub-sieve particle size of less than 2.5 μm and a first particle size distribution with a particle size D10 being less than 2.0 μm and a particle size D100 being less than 10.0 μm; and wherein said polymer matrix is present in an amount ranging from 4 to 6 wt % and said conductive filler is present in an amount ranging from 94 to 96 wt % based on the total weight of said PTC polymer material.

17. The PTC circuit protection device as claimed in claim 16, wherein said first average Fisher sub-sieve particle size of said first tungsten carbide particles is greater than 1.9 μm.

18. The PTC circuit protection device as claimed in claim 16, wherein said first tungsten carbide particles have a total carbon content ranging from 5.0 wt % to 6.1 wt % based on the total weight of said first tungsten carbide particles.

19. A PTC circuit protection device comprising:

a PTC polymer material that includes a polymer matrix and a particulate conductive filler dispersed in said polymer matrix; and two electrodes attached to said PTC polymer material;

wherein said polymer matrix is made from a polymer composition that contains a non-grafted polyolefin; and wherein said conductive filler includes first tungsten carbide particles having a first average Fisher sub-sieve particle size of less than 2.5 μm and a first particle size distribution with a particle size D10 being less than 2.0 μm and a particle size D100 being less than 10.0 μm; and wherein said first tungsten carbide particles have a total carbon content ranging from 5.0 wt % to 6.1 wt % based on the total weight of said first tungsten carbide particles.

20. The PTC circuit protection device as claimed in claim 19, wherein said first average Fisher sub-sieve particle size of said first tungsten carbide particles is greater than 1.9 μm.

* * * * *